US006926088B2

(12) United States Patent
Tinker

(10) Patent No.: US 6,926,088 B2
(45) Date of Patent: Aug. 9, 2005

(54) SEQUENTIAL RELEASE PACKER J TOOLS FOR SINGLE TRIP INSERTION AND EXTRACTION

(75) Inventor: Donald W. Tinker, Rapid City, MI (US)

(73) Assignee: Team Oil Tools, LLC, Tulsa, OK (US)

( * ) Notice: Subject to any disclaimer, the term of this patent is extended or adjusted under 35 U.S.C. 154(b) by 0 days.

(21) Appl. No.: 10/429,670

(22) Filed: May 6, 2003

(65) Prior Publication Data

US 2004/0050546 A1 Mar. 18, 2004

Related U.S. Application Data

(60) Provisional application No. 60/377,612, filed on Aug. 8, 2002.

(51) Int. Cl.[7] ..... E21B 33/12; E21B 33/124

(52) U.S. Cl. ..... 166/387; 166/181; 166/182; 166/191; 166/123; 166/240

(58) Field of Search ..... 166/181, 182, 166/191, 387, 240, 123

(56) References Cited

U.S. PATENT DOCUMENTS

| | | | | | |
|---|---|---|---|---|---|
| 4,962,815 | A | * | 10/1990 | Schultz et al. | 166/387 |
| 5,197,547 | A | * | 3/1993 | Morgan | 166/387 |
| 5,297,633 | A | * | 3/1994 | Snider et al. | 166/387 |
| 5,311,939 | A | * | 5/1994 | Pringle et al. | 166/134 |
| 5,366,019 | A | * | 11/1994 | Brooks | 166/387 |
| 5,692,564 | A | * | 12/1997 | Brooks | 166/127 |
| 6,192,982 | B1 | * | 2/2001 | Divis et al. | 166/187 |
| 6,257,338 | B1 | * | 7/2001 | Kilgore | 166/387 |
| 6,394,184 | B2 | * | 5/2002 | Tolman et al. | 166/281 |

* cited by examiner

*Primary Examiner*—David Bagnell
*Assistant Examiner*—Shane Bomar
(74) *Attorney, Agent, or Firm*—Merek, Blackmon & Voorhees, LLC

(57) ABSTRACT

The present invention is to a pre-selected set of packer tools having J tools and on/off tools ("stingers" and "washovers") with varying strokes and varying set and release directions to enable the operator to individually address the various packers. By increasing the amount of travel necessary to set and/or release the subsequent packer tools, it is possible to select which tool is being manipulated or operated upon.

16 Claims, 4 Drawing Sheets

SEQUENTIAL RELEASE PACKER J TOOLS FOR SINGLE TRIP INSERTION AND EXTRACTION

This application claims benefit to U.S. Application 60/377,612 filed Aug. 8, 2002.

BACKGROUND OF THE INVENTION

A. Field of the Invention

The present invention relates to an arrangement of sequentially configured packer J tools for one trip sequential setting of packer tools and for subsequent one trip sequential release of the tools.

B. Description of the Prior Art

In order to fully exploit natural gas and other well systems, it is often necessary to perform separate operations on multiple zones within the same well. Using either lateral drilling or perforation zones in the well, various depth wells can be exploited. Packer tools are used to separate the zones from each other. The packers are run into the well and are axially compressed to radially expand an elastomeric rubber packer element outwardly into contact with the casing wall to seal the zone above the packer tool from the zone below the packer element. It is typically necessary to run in more than one packer tool to separate the well into a plurality of zones.

Due to the subterranean location of the well and the lack of feasible direct access by the operator to the area where the packer tools are to be set, the packer tools must be set by manipulating the tubing string or wire-line used to insert the packer tools. The basic available motions available to set, manipulate, and release the tools include sitting the string down (i.e., lowering the tubing) to put the tubing in compression, lifting the tubing to add tension, rotating the tubing left or right, or a combination of these movements.

The use of J tools such as shown in U.S. Pat. No. 5,197,547 to Morgan, which is incorporated herein by reference, has provided one solution to setting and releasing tools by providing a cooperating pin in a J shaped slot. By pushing down and rotating the string in the appropriate direction, the follower pin is moved from the running position, to a crossover position, or to a setting position. Until a second compound motion resets the J tool, simple rotation or compression or tension will not upset the packer tool locked in its particular position. This has allowed packer tools to be run into well bores and set very accurately in position at great depths below the surface. Once in place, the packer tool can be released from the tubing string, and the tubing string can be retrieved to the surface. Multiple packer tools can be inserted into the well as needed by running the tubing string into the well bore casing setting a packer tool in position during each trip.

However, it is very time consuming and inefficient to run the tubing string hundreds or even thousands of feet over and over to set the various packer tools into position. It is desirable to run in a single trip a number of packer tools into a well and release the packer tools sequentially from the bottom most to the top most without having to withdraw the tubing string between subsequent packer tool positionings. The current invention provides a novel arrangement and method for accomplishing the sequential setting and/or retrieval of multiple packer tools into a well casing during a single trip.

None of the above inventions and patents, taken either singly or in combination, is seen to describe the instant invention as claimed.

SUMMARY OF THE INVENTION

The present invention is accomplished by using a preselected set of packer tools having J tools and on/off tools ("stingers" and "washovers") with varying strokes and varying set and release directions. By increasing the amount of travel necessary to set and/or release the subsequent packer tools, it is possible to select which tool is being manipulated or operated upon.

In one preferred, illustrative embodiment, dual ball valve completion packers are run in a set of five on a single tubing string into a well casing. Pairs of packers starting from the bottom have identical strokes on the J tools, but alternate in "setting" directions (i.e, the direction the tubing must be manipulated to set the packer). The on/off tools to release the packers after each is set in position may be formed in pairs, with pairs of on/off tools releasing in the same direction but have differing strokes. However, the release direction of the on/off tools may alternate between pairs of on/off tools rather than alternating between each on/off tool.

Accordingly, it is a principal object of the invention to provide a set of packer tools that can be set and/or released in a single trip by individual "addresses" for each packer tool.

It is another object of the invention to provide a set of packer tools that have cooperating J tools and on/off tools to sequentially release and/or retrieve the packer tools at the desired locations.

It is a further object of the invention to provide a novel series of J tool slot patterns that allow individual manipulation of individual packer tools in a set of interconnected packer tools to set or release only the selected packer tool.

Still another object of the invention is to provide a series of varying or alternating on/off tool auto-J patterns that allow the sequential release or retrieval of individual packer tools in a set of interconnected packer tools.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

Figure 1:
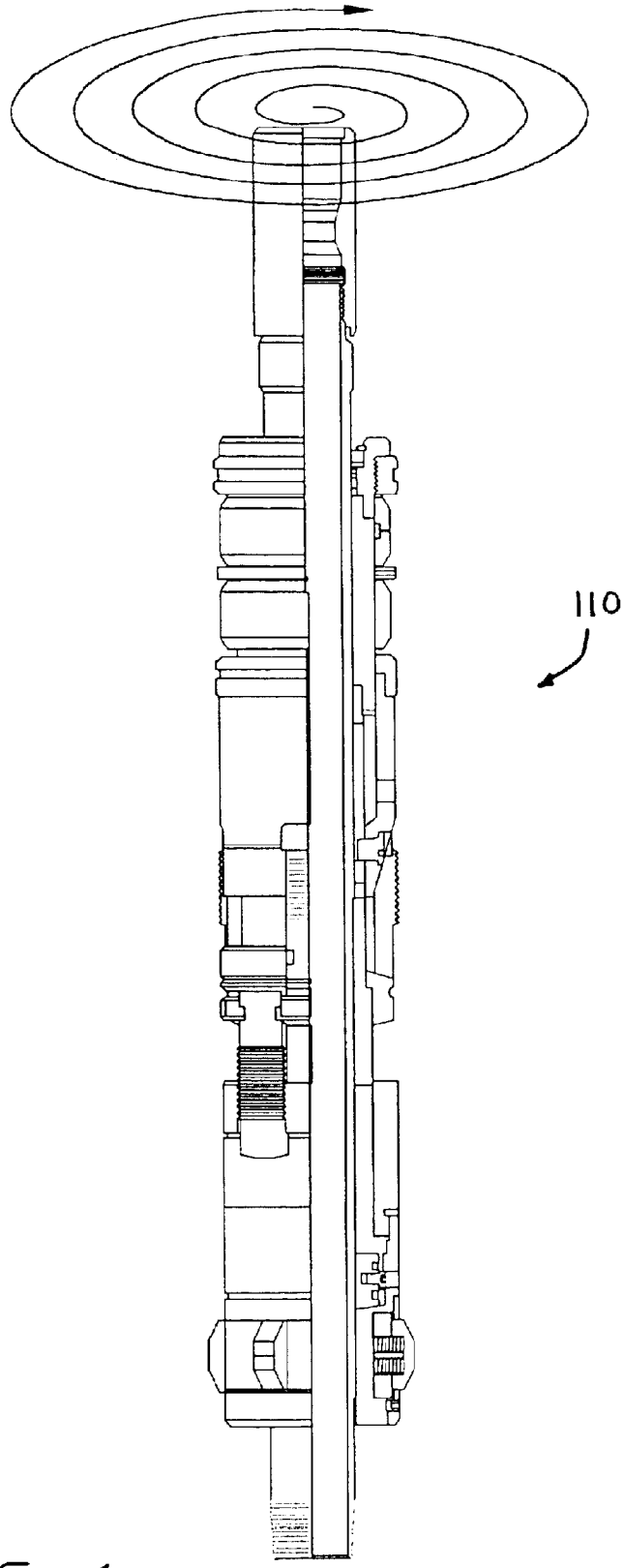
FIG. 1 is a diagrammatic view of the upper most packer according to the present invention.
Figure 2:
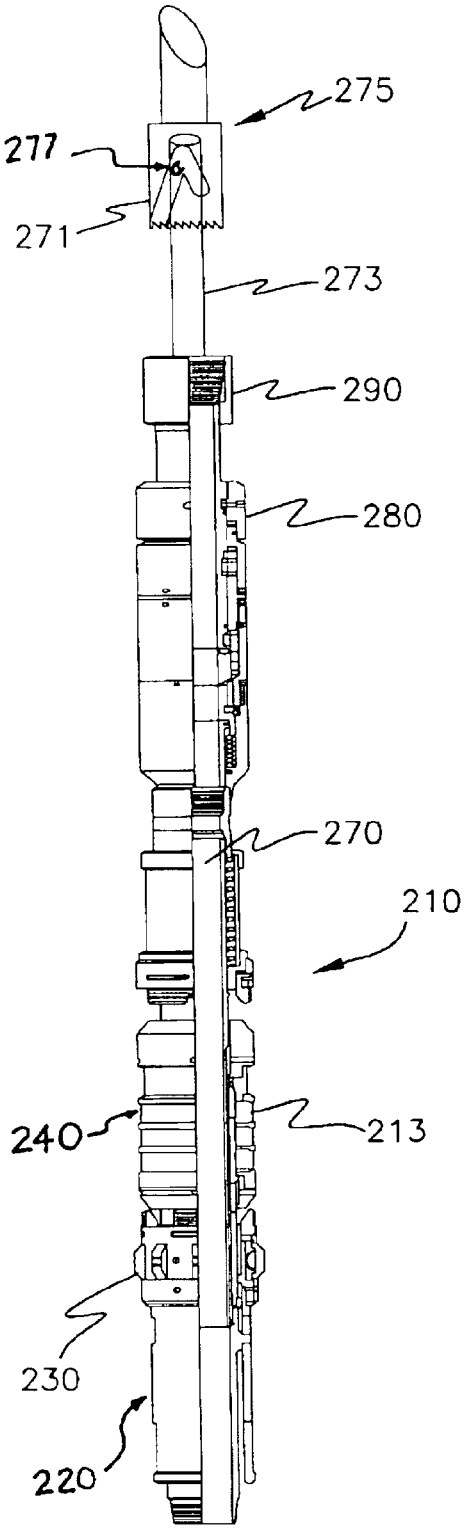
FIG. 2 is a diagrammatic view of the second upper most packer according to the present invention.

Similar reference characters denote corresponding features consistently throughout the attached drawings, including the use of the same terminal two digits of the reference numbers to designate corresponding parts throughout the figures (e.g., references 270, 370, 470, 570 all designate a mandrel in FIGS. 2, 3, 4 and 5, respectively), unless otherwise explicitly noted.

DETAILED DESCRIPTION OF THE PREFERRED EMBODIMENT(S)

The present invention relates to an inventive arrangement and method for the sequential release or extraction of multiple completion packer tools in a single trip. A preferred embodiment of the invention is described below.

As shown in the Figures, a tubing string is connected to a number of completion packer tools. Each packer tool is releasably connected to the next higher packer tool by an on/off tool. As shown in FIG. 1, the upper most packer tool may likewise be connected to the tubing string by an on/off tool, but preferably since completion packers are used in the preferred embodiment, the upper packer is directly connected to the tubing string. In operation, the complete assembly ("string") (FIGS. 1–5) is inserted into a well bore casing and lowered until the lower most packer tool is lowered to the desired depth. During run in, the packer elements of the completion packer are unexpanded so that fluid displaced as the packer tool is lowered can flow freely around the tool. Additionally, flow through the interior tubing through each packer, except for the uppermost packer, is blocked by a ball valve system. The ball valve is closed to delay flow through the tubing until the packer tool is set. One skilled in the art would appreciate that closure of the interior tubing is not necessary to the practice of the invention, but depends entirely on the type of packer tools being set and flow control characteristics desired during setting and operation of the particular well.

When the proper depth has been reached, a packer tool must be set and then disconnected from the tubing string so that the next higher packer tool can be raised to a second desired depth before being set. The current invention shows a series of five completion packer tools in a packer tools set, but one skilled in the art would recognize that various types of packer tools could be run in using the teaching of the current invention and that more or fewer packer tools could make up a complete packer tools set.

Because the packer tools are being manipulated at great depths below the surface invisible to the view of the operator, it is necessary to configure the packer tools so that vanous combinations of movement (up and down, or rotation to the right or left) can be used to reliably address only one particular packer tool or a known combination of packer tools. If a packer tool were to prematurely disengage or fail to reconnect to the tubing string for removal, then the entire tubing string would have to be withdrawn and individual packer tools fished from the well casing at great expense and time costs. The current invention teaches a novel method of saving time and money by providing J tool configurations which allow each packer tool to be "addressed" by a certain movement or combination of movements of the tubing string. One skilled in the art would appreciate that this "addressing" technique has implications beyond the illustrative packer tools and packer tools set described in the preferred embodiment herein and therefore the claims of the invention should not be limited to the preferred embodiments described herein.

Returning to operation of the current invention preferred embodiment, when the lower most completion packer tool has reached the proper depth, the packer tool must be set such that the packer elements on the tool are radially expanded to close the gap around the packer tool. "Packing off" or "setting" is the process where the rubber packer elements are axially compressed between an upper and lower sub (or like device) such that the packer elements are forced radially outward until they contact the inner wall of the well casing. The size and material of the packer elements are chosen for the particular casing such that when expanded, the force between the packer elements and the casing wall is sufficient to seal the area above the packer tool and below the packer tool element.

The setting of the packer tool is accomplished by the operator through either moving the tubing string up or down or rotating the tubing string left or right to manipulate a J tool on the particular packer. As shown in FIG. 5, the lower most packer tool 510 has a J tool comprising a follower pin and a J slot. See copending Patriot Retrievable Production Packer application, U.S. Ser. No. 60/373,309, copending Slip Spring with Heel Notch filed Apr. 18, 2003, or U.S. Pat. No. 5,197,547 to Morgan for a description of the lower drag body and J pins, which are all herein incorporated by reference. The J pins allow the drag bodies to either be moved in conjunction with the packer body (and relative or fixed to the other drag body) or moved towards or away from the packer body (and relative or fixed to the other drag body). During setting, the mandrel is moved up and down to alternately pull the lower drag body upwards and the upper drag body downwards closer and closer to each other until the packer body is compressed within the drag bodies.

Since the upper and lower drag bodies have drag blocks to allow relative motion of the drag bodies and the packer body, movement of the packer body upwards will pull the drag body upward towards the upper drag body until the packer body hits the upper drag body, which was fixed in place in the casing "floating" on the mandrel. The upper drag body is then pulled downwardly with the packer until the packer hits the "fixed and floating" lower drag body. The process is then repeated until sufficient compression of the packer body expands the pack off elements (rubber pack elements) radially outwardly to fix the packer in place. Slips are used on the drag bodies to help lock the drag blocks in place as cones on the packer in turn compress against the drag bodies forcing the slips outward against the casing or wellbore in a known manner. The opposite method is used to free the packer by alternately moving the drag bodies away from the packer body, taking the packer body out of compression and releasing the pack off elements. This pack off or setting process is well known in the art and will not be described further, except as need to describe the unique operation of the present invention.

Operation of a Packer Tool with a J Pin and J Slot

Figure 5A:
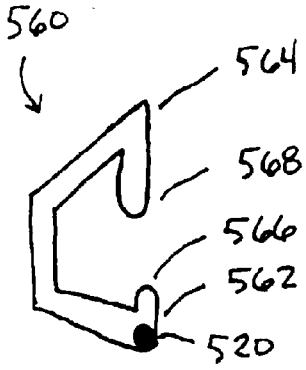
FIG. 5A is a diagrammatic view of the J slot on the mandrel of the fifth packer tool.
Figure 5:
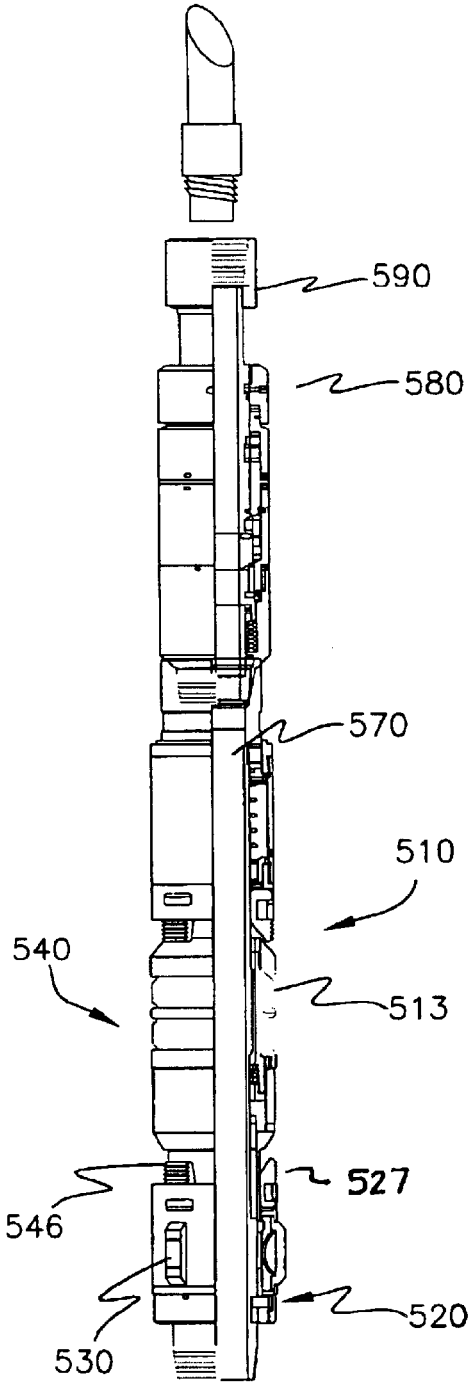
FIG. 5 is a diagrammatic view of the fifth upper most ("lowest") packer according to the present invention.

The J pin 520 shown diagrammatically in FIGS. 5 and 5A provided in the lower drag body 530 controls the relative motion between the lower drag body 530 and the rubber mandrel assembly 540 and likewise the travel of the lower drag body along the tubular extension 546 of the mandrel assembly. As best shown diagrammatically in FIG. 5A, a J slot 560 is provided on an outer surface of the mandrel 570 radially inward from the drag body 530.

The J pin 520 is selected to be of sufficient length to ride within the J slot 560 of the mandrel to control the motion of the drag body between several positions. The J pin 520 is located on the lower drag body and the slot is on the mandrel within the drag body and within the packer body. Therefore, when the pin is in an upper position, the drag body is closest to the packer body, and conversely, when the pin is in a lower position, the drag body is furthest from the packer body.

A first position 562 is provided for run in ("insertion") of the tool 510 where the pin is in an upper position. Since the pin is in the lower most position relative to the mandrel extending below the packer body 540, the drag body is held away from the packer body preventing unwanted compression between on the packer body or the drag body to prevent either the drag body slips from extending or the pack off element from radially expanding and causing undue drag on the tool during lowering. The pin may be shear pinned in this run in location to prevent accidental movement. When a shear pin is used, a predetermined torque or pressure is used to release the pin so that it can travel in the slot. Different shear pins throughout the tool may have sequentially higher shear points to control the sequence of release of the pins.

As described above, the lower drag body 530 is run in while separated from the lower cone of the rubber mandrel to prevent the lower slips 527 from extending and impeding progress of the packer tool's insertion into the well bore. However, the drag block will still be in contact with the well bore to allow the tool to be manipulated as it is inserted.

The J pin has a second position 564 at the topmost portion of the J slot closest to the packer. This is the maximum compression (of the mandrel) resulting from placing the most downward compression on the tubing during setting. When the J pin is in this position, the rubber mandrel assembly and the lower drag body are in close contact with both the packer elements 513 expanded and the slips (not shown) expanded in contact with the well bore. However, it is not necessary to be in this extreme position to fully seal the bore. A tension lock position 568 is located axially below the topmost position which acts in the same way as a shear pin to prevent the drag body from moving further towards the packer body while the tool is lowered or compressed. A similar compression lock position 566 is provided axially above the lowermost position of the slot to prevent release of the packer tool and drag body from compression when the tool is lifted or other forces act on the tool. Even releasing the tension or even putting the tubing in tension (i.e., pulling on the tubing) will cause the J pin to move to the compression lock position 568 where the tubing is in tension, but the rubber mandrel assembly is still in compression ("packed off") and the packer tool cannot be accidentally released solely by upward tension on the tubing. All along the J slot between the compression lock position 568 and the compression position 564 the tubing can be manipulated while the packers remain packed off.

Only when the J pin is rotated rightward (to travel left in the slot) can the packing elements be released or set. This allows the packer tool to be locked in its set position with the tubing in tension, compression or a neutral position between the two.

In operation before running the tool into the well, the tool is lifted carefully to prevent premature release of any part, and placed into the hole. The entire tool is rotated to close each of the ball valves 580, 480, etc. for run in. Since the packers are not expanded, fluid will flow around the outside of the tool during run in.

When the packer is in place, the tool is lowered while applying a right hand torque to allow the J pin 520 to travel downward along the slot 562 to bring the drag body into contact with the packer body 540, to bring the packer body into compression and thereby pack off the packer elements 513 and set the tool in place. The approximate stroke of the lower slot ("amount of maximum vertical pin travel in the slot") is 5–6 inches. This will become important as the fourth and fifth packer tools have 5–6 inch strokes while the second and third packers will have a 10–12 inch strokes. Controlling the amount of travel of the tools will prevent the wrong tool from being acted upon, i.e., limiting the travel to less than 10 inches will allow the $5^{th}$ packer to be released, but not the $3^{rd}$ packer which has a similar release pattern. As will be seen below, the $2^{nd}$ and $4^{th}$ packer will have an opposite ("left hand release") and won't be affected by this motion because of the compression and tension lock positions of the J slots.

With the lowermost packer set and in compression, the string can be lifted to bring the J pin into the compression lock position 568. The tool can be released from the rest of the string by further rotation to the right. The first turn will cause the mechanically set ball valve to close if it is not already closed. However, during initial run in, the ball valve is closed by the initial rotation of the system. The zone below the lowermost tool may be acted upon by releasing the ball valve 580. A clockwise rotation ("left hand") will release the mechanically set ball valve to allow flow from below the zone through the inner mandrel. The zone below the packer can then be fractured ("fraq'd"), pumped, or otherwise acted upon while the inner mandrel is in fluid communication with the surface above the well. A right hand rotation will close the ball valve to isolate the zone below the packer tool at the desired time, which of course will also be sealed outside the mandrel by the packer elements 513.

Further rotation will cause the tubing string to threadedly disengage from the top sub 590 of the lowermost packer tool. The amount of turns necessary to disengage is set to 4–5 turns to release the tool in a quantifiable time period. The zone above the closed packer tool can now be fractured or otherwise acted upon.

Figure 4A:
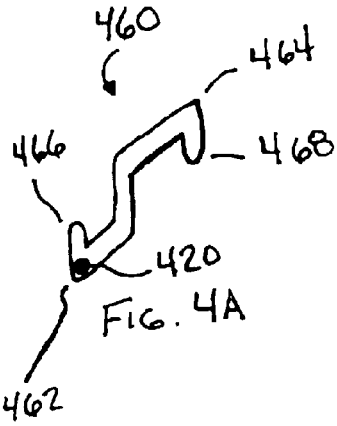
FIG. 4A is a diagrammatic view of the J slot on the mandrel of the fourth packer tool.

To set the fourth packer tool 410 (FIG. 4), the tubing string is lifted up until the fourth packer is in the proper location. Note that the make up of packer tool 4 preferably corresponds to the make up of packer tool 5, and corresponding reference numerals designate corresponding parts, e.g., parts 470 and 570 are both mandrels, parts 490 and 590 are both top subs, etc. The tool is lowered slowly applying a left hand rotation. The rotation is of course enabled by the drag blocks providing sufficient friction to rotate the mandrel relative to the drag body, and thus the J pin 420 relative to the slot 460. As shown in FIGS. 4A, the J slot 460 is reversed from the fifth J slot 560. As the tubing string is set down under a left torque, the J pin 420 travels rightward and up from its run in position 462 to the compression position 464. Tension lock position 466 is located axially above the run in position 462 and compression lock (or "set") position 468 is located axially below the compression position as described relative to the fifth packer to prevent accidental release of the fourth tool from the selected position. When the tubing string is lifted from the compression position 464 the J pin travels into the compression lock or set position 464.

Figure 4:
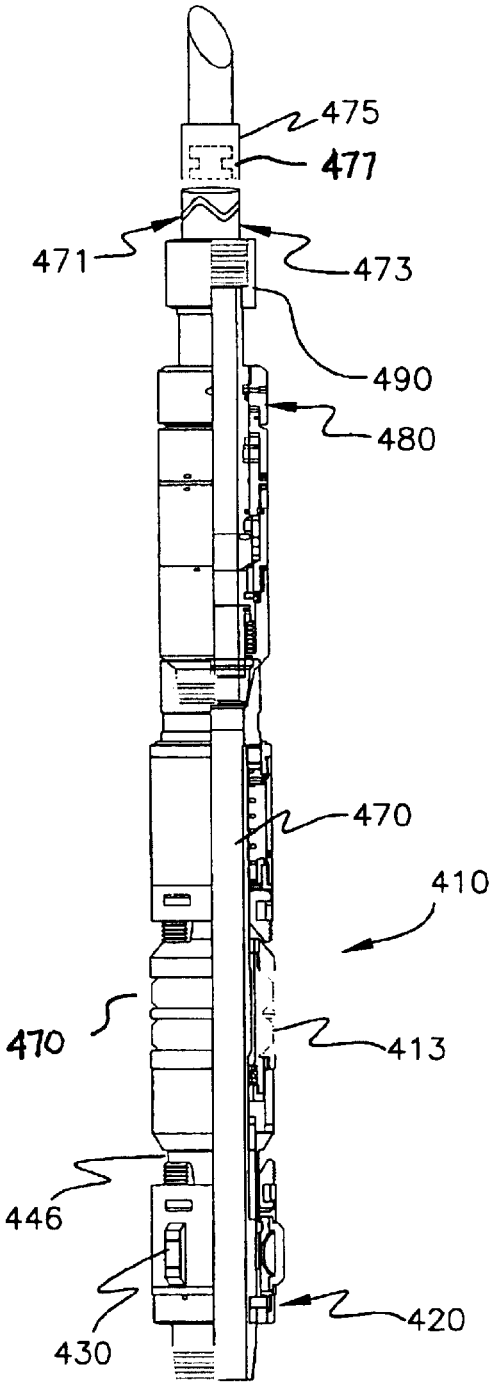
FIG. 4 is a diagrammatic view of the fourth upper most ("second lowest") packer according to the present invention.

A "yo yo" on/off tool is provided for moving the J pin into the proper position. As shown in FIG. 4, the on/off tool 475 has internal lugs 477 that mate with slot 471 of the yo yo stinger 473. Starting from the rightmost position of the slot 471 as the on/off tool is rotated to the left torque is applied to the tubing string and thus the on/off tool, the lugs will travel leftward and up the slot to the first position where the tool can be pulled into tension to lift the fourth packer tool into position. Further left movement allows the J pin to travel downward to a second position where compression can be placed on the fourth packer. The packer will be left in this position while the zone below the packer is acted upon. Further left torque releases the on/off tool from the packer. The on/off tool can be set down on the stinger again to apply tension to release the tool.

Rotation to the left after the J pin 420 is in the set position and the packer tool is expanded and set, causes the ball valve 480 to be released. The zone below the fourth packer and above the fifth packer is then in communication with the surface and can be pumped or otherwise acted upon. Rotation to the right closes the ball valve in preparation to seal the packer in place to isolate the zone above the fourth packer. Further left torque as described above releases the packer tool from the tubing string to separate the fourth packer from the third packer.

The third packer tool 310 has a slot similar and analogous in operation to the fifth packer tool. The slot is approximately twice as long to prevent the third packer from being acted upon prematurely while the fifth packer is still attached. The running position and operation of the J pin 320 along the J slot 360 is the same as described above with respect to the fifth packer, keeping in mind the extended travel of the J pin in the lengthened slots when maneuvering the tools. The ball valve will operate similar to the fifth packer ball valve.

The on/off tool is a manual J pattern release tool. A vertical slot prevents the release of the on/off tool 375 from the stinger 371 through tension or compression alone. The vertical walls of the slot prevent relative movement between the on/off tool 375 and the stinger 371 when the tool is in tension or compression. To release the third packer tool after the zone has been frac'd or otherwise acted upon, a right hand torque is applied and the tubing string is slowly lifted. When the J pin 362 on the stinger aligns with the horizontal slot of the on/off tool, the on/off tool will rotate relative to the stinger 375. When the pin reaches the second vertical slot 365, the on/off tool will remove from the stinger and leave the set packer in place with the ball valve closed.

The second packer tool will operate the same as the fourth packer with twice the travel of the fourth packer to prevent premature actuation of the packer tool. The on/off tool operation is simplified since at this point, the packer will be the only one connected to the tubing string below the topmost packer. The J tool is a left hand set with a left hand auto off J slot on/off tool similar to the fourth packer J tool. After the zone below the second packer is acted upon, and the packer is in the set position with the ball valve closed, the J pin 220 will be at the top most position having moved to that position as the second packer was compressed with left torque. During subsequent lifting of the tubing string with a left torque the J pin 477 will travel down the slot to "automatically" release the second packer.

The top most packer 110 (FIG. 1) is preferably a rotational set pattern packer with no ball valve, since it will be tripped out and not left in place to isolate a further higher zone. However, should the packer be intended to be left in the hole for isolation purposes, a different packer could be used in its place. Rotation of the tool to the right while setting down will set the packers. Further tension can be used to further set the packer. The zone below the first packer 110 and above the second packer 210 can then be acted upon.

Release Operation of the Parkers

When it is desired to remove all the packers from the well bore, they must be individually reconnected to the tubing string and released so that each packer in series can be lowered down to latch onto the next lower packer, until packers one through five have been released and are ready for extraction.

The extraction process will proceed in the reverse order from the insertion process. When it is time to extract the packers, the tubing string will already be connected to packer one, the uppermost packer. To release the packer, the packer must be rotated to the left while being lifted to release the packer.

With the packer one 110 free now to move, the washover ("on/off tool") of the packer one can be lowered into contact with the stinger of the second packer 210. The slot of the washover is designed in well-known manner to facilitate accepting the lugs 277 of the stinger into the washover vertical slot. Since the second on/off tool 275 is a left-hand-off connector, a right hand turn followed by a lifting will move the lugs into the original, locked position connecting the first packer to the second packer. While this is occurring the J pin of the drag body will be raised from the compression locked position to the compression position 268. A right turn while lifting will cause the J pin to travel downward relative to the slot back to its original run in position releasing the packer body 240 from the drag body 220 and releasing the pack off elements 213. The vertical slot will prevent the J pin from moving away from this range during further removal of the other components.

Figure 3:
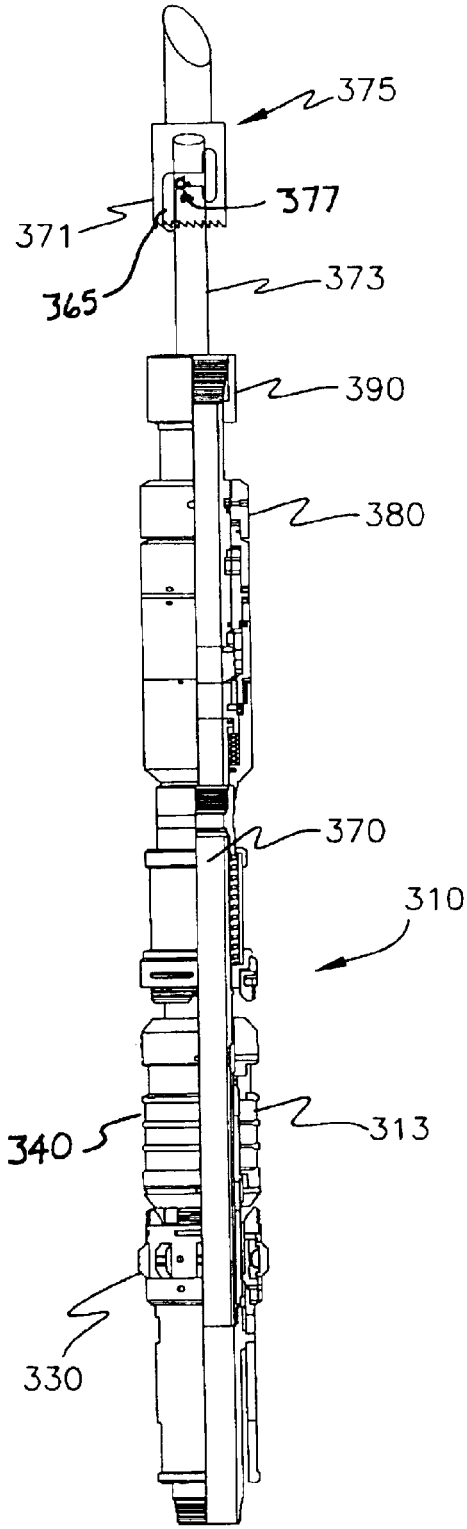
FIG. 3 is a diagrammatic view of the third upper most packer according to the present invention.
Figure 3A:
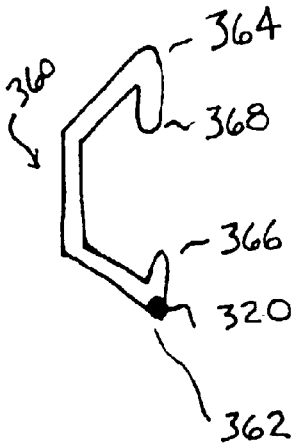
FIG. 3A is a diagrammatic view of the J slot on the mandrel of the third packer tool.
Figure 2A:
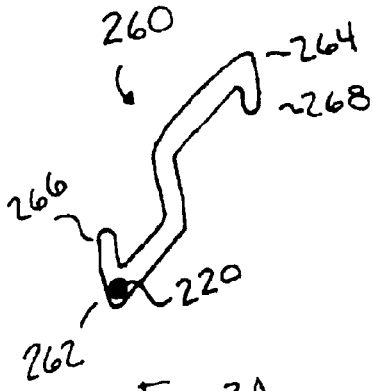
FIG. 2A is a diagrammatic view of the J slot on the mandrel of the second packer tool.

The first and second packer are then lowered as a unit on the tubing string to pick up the third packer. The on/off tool 375 as shown in FIG. 3 is rotated slowly to the left to mate the J pin 377 to the slot 371. The slot may be flared at the bottom to facilitate this process. Once the pin is in the slot and the tubing string is lowered with the left torque, the pin will travel to the top most allowed by the second vertical slot 365, and then will be forced to travel to the right relative to the right turning on/off tool. At this point the tool can be lifted further to cause the J pin 320 to move from the compression lock ("set") position 368 to the compression position 364. Further right torque and lifting will cause the J pin 320 to travel along the slot to the running position 362 releasing the packer body 340 from compression and releasing the third packer to rise with the tubing string.

The tubing string is then lowered to mate the third on/off tool 475 to the fourth packer stinger 473. Rotation to the right after the on/off lugs 477 of the on/off tool 475 mates with the stinger will cause the on/off lugs to travel down the slot to prepare for raising. While right torque is applied and the tubing string is raised, causing the on/off lugs to move up along the slot 471. When the pin hits the upmost point of the slot 471, the tubing string will act upon the J pin 420. The J pin 420 having been freed from the compression lock position during the hook up of the stinger with the on/off tool, will then move downwardly along the slot 460 to release the drag body from the packer and release the packer 440 from compression to free the fourth packer tool 410 to move with the tubing string.

The tubing string can then be lowered to the fifth packer tool. Right torque will rethread the tubing string to the fifth packer tool 510. As the tools are joined under compression, the J pin 520 of the fifth packer will move to the compression position 564 and then under further right hand torque will release the J pin to travel to the running position 562 to release the drag body and the fifth packer allowing the entire tool with all five packers in tow to be retrieved in a single trip.

By varying the J tool configuration in the lower sub used to set and release the packer tool and by varying the J tool configuration of the on/off tool, pre-selected motion of the tubing string can be used to "address" and manipulate individual packer tools on the tubing string.

It is to be understood that the present invention is not limited to the sole embodiment described above, but encompasses any and all embodiments within the scope of the following claims.

What is claimed is:

1. A packer tool set having at least two selectively disconnectable packer tools for insertion into a wellbore, comprising:

a first of said two packer tools having a first J tool including a first J slot for setting said first packer tool;

a second of said two packer tools having a second J tool including a second J slot for setting said first packer tool;

wherein said first J tool first J slot is substantially longer than said second J slot of said second J tool such that when said first and second packer tools are connected, lifting said packer tool set a predetermined distance releases said first packer tool, but does not release said second packer tool.

2. A packer tool set according to claim 1, wherein said first J tool first J slot is at least 10% longer than said second J slot of said second J tool.

3. A packer tool set according to claim 1, wherein said first J tool first J slot is at least 25% longer than said second J slot of said second J tool.

4. A packer tool set according to claim 1, wherein said first J tool first J slot is at least 50% longer than said second J slot of said second J tool.

5. A packer tool set according to claim 1, wherein said first J tool first J slot is at least 100% longer than said second J slot of said second J tool.

6. A drill string having at least three interconnected packer tools for inserted in a wellbore, comprising:

a first of said three packer tools having a first J tool including a first J slot for setting said first packer tool;

a second of said three packer tools having a second J tool including a second J slot for setting said second packer tool;

a third of said three packer tools having a third J tool including a third J slot for setting said third packer tool;

wherein each of said first, second and third J slots has a different configuration and/or length from each other first, second and third J slot such that a first predetermined manipulation of said drill string operates to release said first packer tool from said second packer tool while preventing said second packer tool from releasing from said third packer tool.

7. The drill string of claim 6, wherein said third packer tool third J slot is longer than said first J slot on said first packer tool to prevent early release of said third packer tool during release of said first packer tool from said second packer tool.

8. The drill string of claim 6, wherein said first packer tool first J slot is right hand release and said second packer tool second J slot is left hand release.

9. The drill string of claim 6, wherein said first packer tool first J slot is left hand release and said second packer tool second J slot is right hand release.

10. The drill string of claim 6, further comprising at least one shear pin on said second packer tool pinning said second packer tool in a run in position for preventing early movement of said second J tool relative to said third packer tool and for preventing early release of said second packer tool from said third packer tool.

11. A method of disconnecting a first packer tool from a second packer tool, comprising the steps of:

providing a first packer tools with a first J tool pin on a first drag body selectively slidable along a first J slot defined by a mandrel on said first packer tool for setting said first packer tool;

providing a second packer tools with a second J tool pin on a second drag body selectively slidable along a second J slot defined by a mandrel on said second packer tool for setting said second packer tool, wherein said first packer tool first J slot is substantially longer than said second packer slot of said second J tool;

inserting said first packer tool and said second packer tools into a wellbore;

connecting said first packer tool to said second packer tool;

lifting and manipulating said first and second packer tool to cause said first J tool pin to slide along said first J slot to allow release of said first packer tool while said second J slot pin slides along said second J slot a distance insufficient to allow said second J tool pin to reach a run in position and without releasing said second packer tool.

12. The method of disconnecting a first packer tool from a second packer tool, of claim 11, wherein during said lifting and manipulating step, lifting and manipulating said first and second packer tool causes said first J tool pin to slide a predetermined distance along said first J slot from a compression locked position to a run in position to allow release of said first packer tool while causing said second J tool pin to said predetermined distance slide a predetermined distance release without allowing said second J tool pin to reach a run in position and without releasing said second packer tool.

13. The method of disconnecting a first packer tool from a second packer tool, of claim 11, wherein said second J slot is at least 10% longer than said first J slot.

14. The method of disconnecting a first packer tool from a second packer tool, of claim 11, wherein said second J slot is at least 25% longer than said first J slot.

15. The method of disconnecting a first packer tool from a second packer tool, of claim 11, wherein said second J slot is at least 50% longer than said first J slot.

16. The method of disconnecting a first packer tool from a second packer tool, of claim 11, wherein said second J slot is at least 100% longer than said first J slot.

* * * * *